United States Patent [19]

Dirksing et al.

[11] Patent Number: 4,462,121

[45] Date of Patent: Jul. 31, 1984

[54] PASSAGEWAY RESISTANT TO CAPILLARY TRANSPORT

[75] Inventors: Robert S. Dirksing; Bruce A. Yeazell, both of Cincinnati, Ohio

[73] Assignee: The Procter & Gamble Company, Cincinnati, Ohio

[21] Appl. No.: 360,104

[22] Filed: Mar. 19, 1982

[51] Int. Cl.[3] ..... E03D 9/03

[52] U.S. Cl. ..... 4/228; 4/223; 4/227; 229/3.1

[58] Field of Search ..... 4/223, 225, 227, 222, 4/228; 106/33, 270; 222/189, 190; 229/3.1

[56] References Cited

U.S. PATENT DOCUMENTS

| | | | |
|---|---|---|---|
| 190,122 | 5/1877 | Budd | 106/270 |
| 662,695 | 11/1900 | Lichtenstadt | 106/270 |
| 1,555,501 | 9/1925 | King | 106/270 |
| 1,634,002 | 6/1927 | Tom | 106/270 |
| 1,739,582 | 12/1929 | Ellis | 106/270 |
| 1,752,933 | 4/1930 | Sullivan, Jr. | 106/270 |
| 2,341,845 | 2/1944 | Mark et al. | 229/37 |
| 3,015,596 | 1/1962 | Couch et al. | 229/3.1 |
| 3,391,846 | 7/1968 | White | 229/3.1 |
| 3,403,064 | 9/1968 | Bellamy | 156/273 |
| 3,618,143 | 11/1971 | Hill et al. | 4/228 |
| 3,679,509 | 7/1972 | Fielibert | 156/182 |
| 4,208,747 | 6/1980 | Dirksing | 4/227 |
| 4,305,162 | 12/1981 | Cornelisse | 4/227 |
| 4,307,474 | 12/1981 | Choy | 4/227 |

*Primary Examiner*—William Price
*Assistant Examiner*—Bryon Gehman
*Attorney, Agent, or Firm*—Richard C. Witte; John V. Gorman; Ronald J. Snyder

[57] ABSTRACT

A passageway resistant to capillary transport and which is defined by a circumscribing wall made of heat sealable plastic sheets which are joined along longitudinally extending fin-type heat seals. The joints each have a fillet section which is in intimate contact with the wall along portions contiguous the heat seals and which fills the capillary channels therebetween. The fillets are made of a material which will not be displaced by a liquid which contacts the passageway in use.

4 Claims, 5 Drawing Figures

PASSAGEWAY RESISTANT TO CAPILLARY TRANSPORT

TECHNICAL FIELD

The present invention relates to passageways constructed from fin-sealed thermoplastic sheeting and, more particularly, to such passageways which must resist undesired capillary transport of liquid.

BACKGROUND ART

Articles constructed of plastics are sometimes used in situations wherein it is essential to confine a liquid to a certain portion of the article to regulate dispensing of the liquid, to accurately measure the volume of the liquid, or the like. An illustration of such needs is found in connection with the toilet tank additive dispenser shown in U.S. Pat. No. 4,208,747, which issued to Robert S. Dirksing on June 24, 1980, wherein a passageway providing a bubble lock is used to isolate the product solution from toilet tank water in a syphon tube during non-flush periods. The present invention involves the recognition that when such a dispenser is constructed in a preferred manner, wherein the same comprises heat sealable thermoplastic sheets one or more of which are formed sections defining the chambers and passageways therein and with fin-type heat seals bordering the bubble lock passageway, leakage of the product solution to the toilet tank water can occur. The present invention further involves the discovery that such leakage is due to capillary transport of the product solution alongside the fin-type heat seals and the development of a structure designed to eliminate the problem.

Similar problems are believed to be found in connection with fin-type heat seals bordering the passageway of disposable hospital type fluid measuring devices, e.g. urinalysis bags.

The discovered art does not disclose recognition of the problem or the concept of the present invention's solution. For example, the aforementioned Dirksing patent describes constructing the passive dosing dispenser from two sections of material, one or both of which can be thermoformed, and sealed to each other by heat sealing, adhesives, etc., but does not indicate the potential problem of capillary transport.

Some prior art patents are directed to heat sealing through intermediate layers of materials. Bellamy Jr., U.S. Pat. No. 3,403,064, issued Sept. 24, 1968, concerns a method of forming a composite plastic container with an inner and outer seal, thus forming a container within a container. The laminates of polyvinyl chloride and polyhalohydrocarbon are assembled with the polyhalohydrocarbon faces in contact and radio frequency energized sealing dies used to join them. The heat melts and softens the PVC and polyhalohydrocarbon and the pressure of the dies forces the PVC through the polyhalohydrocarbon, forcing it out of the area between the dies. The PVC layers become heat sealed between the dies and the polyhalohydrocarbon layers unite in an inner seal alongside the PVC heat seal. Mark et. al., U.S. Pat. No. 2,341,845, issued Feb. 15, 1944 relates to a carton in which the closure flaps have sealing surfaces which are provided with a layer of heat-activatable adhesive covered by a layer of a wax composition. When the carton is sealed the sealing surfaces are heated, melting the wax layer and making the adhesive tacky, and pressed together. The molten wax flows from between the flaps and collects at the sides of the flaps, forming additional seals.

Fielibert, U.S. Pat. No. 3,679,509, issued July 25, 1972, on the other hand, teaches a process for sealing laminated materials for food containers. The laminates sealed are each polypropylene coated aluminum foil and are arranged with the coatings in contact. One of the heat sealing jaws is crowned so as to exert the greatest pressure along the center line of the heat seal area. When applied, the polypropylene layers retract from the center zone and form integral seals on each side of the parting line. As mentioned above, however, none of these references teach the problem or solution of the present invention.

It is an object of the present invention to obviate the above described problem.

Another object of the present invention is to provide an effective, economical fin-type heat seal joint for use in assembling articles wherein liquids must be confined to certain locations.

It is a further object of the present invention to provide a device employing fin-type heat seals to define a passageway and wherein such passageways are resistant to capillary transport by liquids contacting an end of the same.

DISCLOSURE OF THE INVENTION

Briefly stated, in accordance with one aspect of the present invention there is provided a device having means to prevent capillary transport of a liquid to be placed therein. The means comprises a reservoir portion adapted to receive and hold the liquid and an outwardly extending passageway with one end in communication with the reservoir. The passageway has a circumscribing wall comprising a pair of sheets of heat sealable thermoplastic materials, at least one of which is formed with a passageway-defining recess therein and a heat seal flange on each longitudinal side of the recess. The thermoplastic sheets are united along the flanges by longitudinally extending joints on each side of the passageway. The joints have an outer fin-type heat sealed section and an inner fillet section which isolates the heat sealed section from the passageway. The fillet section is made of a material in intimate contact with the wall along the portions thereof contiguous the inner edge of the heat sealed section and filling the capillary channels therebetween. The fillet material has properties which prevent its displacement by the liquid to be placed in the device.

BRIEF DESCRIPTION OF THE DRAWINGS

While the specification concludes with claims particularly pointing out and distinctly claiming the subject matter which is regarded as forming the present invention, it is believed that the invention will be better understood from the following description taken in connection with the accompanying drawing, in which:

DETAILED DESCRIPTION OF THE INVENTION

Figure 1:
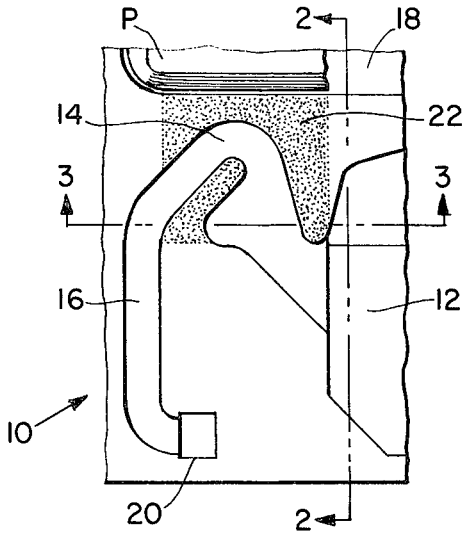
FIG. 1 is a fragmentary plan view of a thermoformed section of a device embodying the present invention.

Referring now to the drawing in which like numerals indicate like elements throughout the several views, a preferred embodiment is shown. The embodiment illustrated is an improvement of the passive dosing dispenser employing a trapped air bubble to provide an air lock, as disclosed in the aforementioned Dirksing, U.S. Pat. No. 4,208,747, the disclosure of which is hereby incorporated by reference. In particular, the improvement relates to the passageway which interconnects the primary product reservoir of the Dirksing dispenser with the syphon tube thereof.

Figure 2:
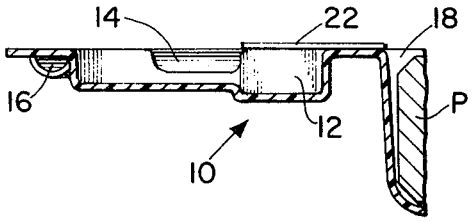
FIG. 2 is a fragmentary cross sectional view of the thermoformed section of FIG. 1, taken along the line 2—2 thereof.
Figure 3:
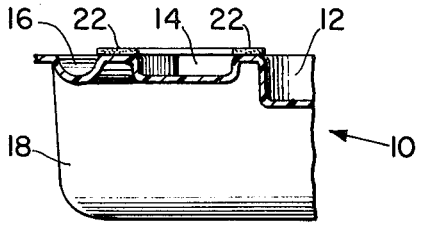
FIG. 3 is a fragmentary cross sectional view of the thermoformed section of FIG. 1, taken along the line 3—3 thereof.

As shown in FIGS. 1–3, a formed section 10 of the dispensing device provides recesses defining a reservoir portion 12, the upper end of which is of slightly greater depth than the lower end, a passageway 14 having one end communicating with reservoir portion 12 and extending outwardly therefrom to a syphon tube 16 and a solid product chamber 18 containing water soluble product P. A rectangular opening 20 is cut through the material comprising the formed section 10 at the lower end of syphon tube 16 to serve as the inlet/discharge port for the device in use, as will be understood more clearly by reference to the aforesaid Dirksing patent. The formed section 10 can be prepared, for example, by thermoforming, injection molding and the like.

The lands of formed section 10 surrounding the recesses described are adapted to serve as heat seal flanges and the portions thereof on each longitudinal side of the recess defining passageway 14 are coated with a fillet-forming material 22. The material 22 for the described embodiment has a melting temperature lower than or equal to the heatsealing temperature of the material of formed section 10 and must be of a composition which will not interfere with the heat seals to be made on the device, e.g. will be squeezed from between the heat sealed surfaces during the heat seal operation. Preferably, material 22 is non-wettable by an aqueous solution of the product P, i.e. the contact angle of the solution on the material 22 exceeds about 90°. (The contact angle is the included angle between the substrate-liquid interface and a line, in a vertical plane, which is tangent to the liquid-air interface and extends through a point on the periphery of the substrate-liquid interface.) This non-wetability property will serve to inhibit capillary flow even in situations where the fillet may later be imperfectly formed for some reason. The material 22 is preferably also sufficiently flexible to conform to bending and flexing stresses expected to be applied to the device in use, should have properties which will prevent the aqueous solution from displacing it in use and, preferably, is non-reactive with and incapable of contaminating the aqueous solution.

In the described embodiment the material 22 preferable comprises petroleum waxes and, more particularly, an admixture of approximately equal parts by weight of paraffin wax and petrolatum. An example of a suitable commercially available paraffin wax is marketed by Fischer Scientific Company, Chemical Manufacturing Division, of Fair Lawn, N.J. and identified as Hard Paraffin No. D-22. A satisfactory petrolatum is marketed by Chesebrough Ponds, Inc., Greenwich, Conn., under the trademark "Vaseline" Pure Petroleum Jelly. The paraffin wax and petrolatum are heated together to a temperature of about 55° C., mixed and applied as a coating of sufficient thickness to form the desired fillet, as will be understood from subsequent description. In general, the size and geometry of the heat seal flanges alongside the passageway 14, the dimensions of the heat seals to be made therealong and like variables influence the quantity of material 22 needed. For the described embodiment in which the area of the sealing flange portions coated is approximately 5.3 $cm^2$, 0.3 grams of material 22 suffices.

Figure 4:
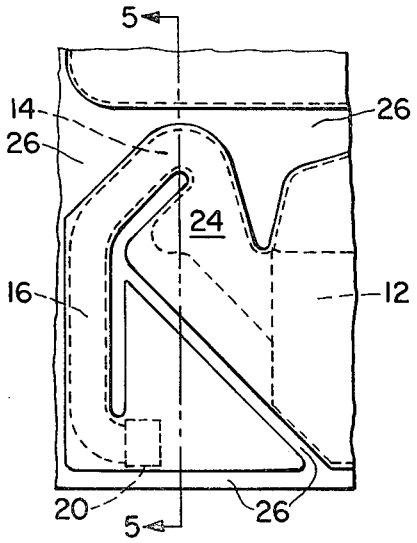
FIG. 4 is a fragmentary plan view of an assembled and heat sealed device of the present invention employing the thermoformed section of FIG. 1.
Figure 5:
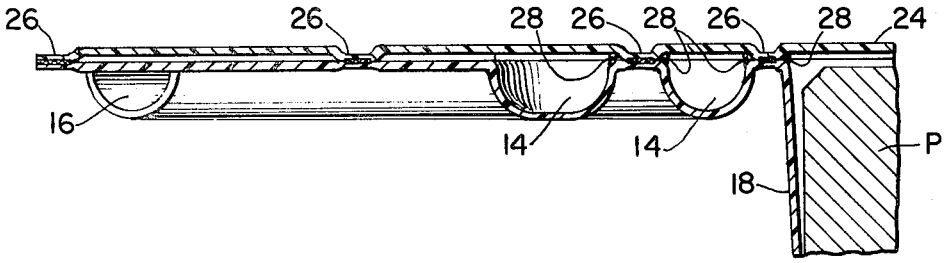
FIG. 5 is an enlarged fragmentary cross sectional view of the assembled and heat sealed device of FIG. 4, taken along the line 5—5 thereof.

A cover section 24, shown in the assembled devices of FIGS. 4 and 5, is initially a planar section, not shown, with overall dimensions generally matching those of formed section 10. Both cover section 24 and formed section 10 are formed of mutually heat sealable materials. In the preferred embodiment the material for both is polyvinyl chloride, the cover section 24 having a thickness of 0.3 mm. and the formed section 10 is thermoformed from a sheet having an initial thickness of 0.55 mm. which is attenuated to a thickness of about 0.33 mm. to 0.46 mm. by the thermoforming.

The device is assembled by registering the planar cover section 24 on the lands of the product-filled formed section 10 and, with matching heat sealing dies above and below the superposed sections, applying heat and pressure to form fin-type, i.e. face-to-face, heat seals 26, the edges of which are shown by solid lines in the fragmentary plan view of the completed device illustrated in FIG. 4. Various heat sealing procedures and equipment are well known by those of ordinary skill in the art and will not be described in detail herein. In the described embodiment, for example, the dies can be heated to approximately 120° C. by electric heaters and an RF (radio frequency) heating device used to heat and melt material 22 and the contacting surfaces of the sections 10 and 24 to approximately 175° C., during a six second cycle in which a pressure of about 10 Kg. per $cm^2$ is applied to the heat seal sections.

As will be noted from the cross-section of FIG. 5, the heat sealing operation causes the sections 10 and 24 to deform slightly along the heat seals 26. This in turn causes separation of the parts of sections 10 and 24 which are immediately adjacent the heat seals 26. In the described embodiment this separation is about 0.2 mm and becomes smaller as the juncture of the heat seal is approached. Thus, a small crevice or channel occurs immediately adjacent the heat seals 26 regardless of how well the sealing dies are aligned. These channels are particularly troublesome alongside passageway 14, because in the absence of the fillet-forming material 22 such channels have the propensity of transporting an aqueous solution of product P (the solution being located in reservoir portion 12 in use) from the reservoir portion 12 to the syphon tube 16 (which contains toilet tank water in use). This renders the desired bubble air lock separation inefficient and can provide a slow buildup of the concentration of the additive in the toilet tank.

The present invention obviates this possibility through the use of the described fillet-forming material 22. In this connection, during the heat sealing operation, the material 22 becomes molten and is squeezed from the heat seal 26 areas outwardly, intimately contacting the walls of the sections 10 and 24 and filling all the capillary channels alongside the passageway 14. Following the heat seal operation material 22 solidifies in the described position. Thus, the joints formed longitudinally along passageway 14 each comprise an outer fin-type heat sealed section and an inner fillet section 28 made of material 22. Since all of the capillary channels described are filled, the capillary transport potential of the sealed dispenser along the passageway 14 is eliminated.

In applications in which the passageway involved is defined by materials other than PVC or other radio frequency heat sealable materials, other kinds of sealing methods can be used, such as ultrasonic welding or simple hot bar sealing. It is possible in some cases that the fillet forming material 22 would serve as a release agent which could interfere with the bonding or fusion process. In such circumstances, the fillet forming material 22 could be introduced after the sealing operation has been performed, by selecting a fillet-forming material 22 which has sufficient low viscosity and affinity for the sealed thermoplastic sheets so as to either flow or be drawn into the capillary channels. The subsequent application of the material 22 could be by daubing or painting it on with a brush, spraying it, extruding a bead of liquid material 22 or similarly placing the same along the heat seals on each longitudinal side of the passageway. The material should preferably set after it has filled the capillary channels. The setting of the material 22 may be due to temperature change hardening as in the case of waxy materials. It could also be due to a chemical setting as in the case of epoxy resins or room temperature vulcanizing (RTV) type silicone rubbers. (RTV type silicone rubbers are available from the General Electric Co., Silicone Division, Waterford, N.Y. One of the G.E. products is designated as RTV #602, an air curing variety, and another is designated as RTV #619, a two component product.) Although there are many types of materials 22 which are feasible for use, the common and necessary result is an inability of the liquid, which will later contact or flow through the passageway formed by the thermoformed plastic sheets, to displace the fillet forming material 22 in the finished device.

Other types of materials 22 which fulfill the specifications described above can also be used. The selections of an appropriate material 22 will, to a substantial extent also depend on other factors such as the type of thermoplastic sheets used, the manner of heat sealing, the type of heat sealing equipment, the structure of the device in which the passageway is to be located and the like. Potential materials 22 for application as a film and later displacement by the heat sealing operation, for example, may not be suitable for use where the fillet forming material 22 is applied after the heat seal is made and vice versa. Materials 22 which could have utility in one situation or the other or in both include, but are not limited to, certain silicones, certain heavy hydrocarbon oils, light greases, animal waxes, vegetable waxes, other mineral waxes such as fossil or earth waxes and synthetic waxes.

This invention can be used with other devices of similar construction, i.e. where a passageway communicates with a liquid reservoir, is defined by a thermoformed wall portion and assembled by a fin-type heat seal. The need for its use can be determined by placing the liquid in a beaker, coloring it with food color if the liquid is clear, and immersing one end of the passageway in question in the liquid. Close observation will detect undesired capillary transport. Where the passageway serves to convey the liquid from the reservoir periodically, thus more or less priming the capillary channels in use, it would be desirable to similarly prime the channels prior to the test described above.

The terms and expressions which have been employed are used as terms of description and not of limitation. It is not intended by the use of such terms and expressions to exclude any equivalents of the features shown and described or portions thereof, but it is recognized that various modifications are possible within the scope of the invention claimed.

What is claimed is:

1. In a device for confining liquids and including an interior reservoir, an outwardly extending capillary transport resistant passageway having one end thereof in direct communication with said reservoir, said passageway having a circumscribing wall comprising a pair of sheets of heat sealable thermoplastic material, at least one of said sheets being formed with a passageway-defining recess therein and having a heat seal flange on each longitudinal side of said recess, said thermoplastic sheets being united along said flanges by longitudinally extending joints on each side of the passageway, said joints comprising an outer fin-type heat sealed section having a capillary channel immediately adjacent thereto and an inner fillet section which isolates the heat sealed section from the passageway, said fillet section being made of a material in intimate contact with said wall along the portions thereof contiguous the inner edge of the heat sealed section and filling the capillary channel longitudinally along said passageway, said material having properties which prevent its displacement by the liquid to be placed in said device.

2. The device of claim 1 in which said material is non-wettable by the liquid to be placed in said device.

3. The device of claim 1 in which said material is flexible and non-reactive with the liquid to be placed in said device.

4. The device of claim 2 or 3 in which said material comprises petroleum wax.

* * * * *